US010165830B2

(12) United States Patent
Nishiwaki et al.

(10) Patent No.: US 10,165,830 B2
(45) Date of Patent: Jan. 1, 2019

(54) SHOE UPPER

(71) Applicant: ASICS CORPORATION, Kobe-shi (JP)

(72) Inventors: Tsuyoshi Nishiwaki, Kobe (JP); Shingo Takashima, Kobe (JP); Hisanori Fujita, Kobe (JP); Yoshinori Fujita, Kobe (JP)

(73) Assignee: ASICS CORPORATION (JP)

( * ) Notice: Subject to any disclaimer, the term of this patent is extended or adjusted under 35 U.S.C. 154(b) by 87 days.

(21) Appl. No.: 15/313,371

(22) PCT Filed: May 29, 2014

(86) PCT No.: PCT/JP2014/064275
§ 371 (c)(1),
(2) Date: Nov. 22, 2016

(87) PCT Pub. No.: WO2015/181928
PCT Pub. Date: Dec. 3, 2015

(65) Prior Publication Data

US 2017/0215523 A1 Aug. 3, 2017

(51) Int. Cl.
*A43B 1/04* (2006.01)
*A43B 23/02* (2006.01)
(Continued)

(52) U.S. Cl.
CPC ..... *A43B 23/028* (2013.01); *A43B 1/04* (2013.01); *A43B 5/06* (2013.01); *A43B 7/08* (2013.01);
(Continued)

(58) Field of Classification Search
CPC .... A43B 1/04; A43B 7/06; A43B 7/08; A43B 7/084; A43B 7/085; A43B 23/02;
(Continued)

(56) References Cited

U.S. PATENT DOCUMENTS 2,147,197 A 2/1939 Glidden
5,377,430 A * 1/1995 Hatfield ..... A43B 3/08 24/714.6
(Continued)

FOREIGN PATENT DOCUMENTS

JP 2011/136253 A 7/2011
JP 2012/196488 A 10/2012
(Continued)

OTHER PUBLICATIONS

International Search Report Issued in PCT/JP2014/064275 dated Oct. 28, 2014.

*Primary Examiner* — Marie Bays
(74) *Attorney, Agent, or Firm* — Katten Muchin Rosenman LLP

(57) ABSTRACT

An upper including: a plurality of panels provided in a medial side portion and/or a lateral side portion, the panels being separated from one another in a longitudinal direction of a foot, covering at least a portion of the side surface of the foot, and being pulled by a fastening member toward a center portion between the medial side and the lateral side of the foot; and a plurality of string-like non-stretchable string portions that are extending in the longitudinal direction, the string portions placed between a pair of the plurality of panels that are adjacent to each other in the longitudinal direction.

7 Claims, 12 Drawing Sheets

(51) Int. Cl.
*A43B 7/08* (2006.01)
*A43B 5/06* (2006.01)
*A43C 1/04* (2006.01)

(52) U.S. Cl.
CPC ..... *A43B 7/085* (2013.01); *A43B 23/02* (2013.01); *A43B 23/026* (2013.01); *A43B 23/027* (2013.01); *A43B 23/0215* (2013.01); *A43B 23/0235* (2013.01); *A43B 23/0265* (2013.01); *A43B 23/0275* (2013.01); *A43C 1/04* (2013.01)

(58) Field of Classification Search
CPC ..... A43B 23/0205; A43B 23/026; A43B 23/0265; A43B 3/12; A43B 3/122; A43B 3/126
USPC ..... 36/11.5, 50.1, 3 A, 45
See application file for complete search history.

(56) References Cited

U.S. PATENT DOCUMENTS

D518,283 S 4/2006 Kayano et al.
D527,174 S 8/2006 Kayano et al.
D527,516 S 9/2006 Kayano et al.
D528,761 S 9/2006 Kayano et al.
7,613,588 B2 11/2009 Katsu et al.
7,836,608 B2 * 11/2010 Greene ..... A43B 13/141 36/102
7,870,681 B2 * 1/2011 Meschter ..... A43B 3/26 36/45
8,037,621 B2 * 10/2011 Hooper ..... A43B 7/06 36/102
8,266,827 B2 * 9/2012 Dojan ..... A43B 23/025 36/45
8,272,148 B2 9/2012 Nishiwaki et al.
8,656,606 B2 * 2/2014 Hooper ..... A43B 7/06 36/102
8,713,821 B2 5/2014 Nishiwaki et al.
9,259,054 B2 2/2016 Nishiwaki et al.
9,675,130 B2 * 6/2017 Ueda ..... A43B 1/14
2005/0076536 A1 4/2005 Hatfield et al.
2006/0117600 A1 * 6/2006 Greene ..... A43B 13/141 36/9 R
2007/0199210 A1 * 8/2007 Vattes ..... A43B 13/12 36/45
2009/0014424 A1 * 1/2009 Meschter ..... A41D 31/02 219/121.69
2009/0133287 A1 * 5/2009 Meschter ..... A43B 7/14 36/12
2009/0229144 A1 9/2009 Sussman
2010/0269369 A1 10/2010 Nishiwaki et al.
2011/0197475 A1 * 8/2011 Weidl ..... A43B 1/0009 36/107
2012/0011744 A1 * 1/2012 Bell ..... A43B 1/0072 36/91
2012/0240429 A1 9/2012 Sokolowski et al.
2013/0008053 A1 1/2013 Nishiwaki et al.
2013/0074374 A1 3/2013 Droege et al.
2013/0139329 A1 * 6/2013 Ferniani ..... A43B 7/08 12/128 R
2014/0259760 A1 * 9/2014 Dojan ..... A43B 23/026 36/45
2015/0289589 A1 10/2015 Nishiwaki et al.
2016/0058100 A1 * 3/2016 Dealey ..... A43B 1/04 36/84
2016/0095377 A1 * 4/2016 Tamm ..... A43B 3/0036 36/9 R

FOREIGN PATENT DOCUMENTS

WO WO-2007/140054 A1 12/2007
WO WO-2008/000398 A1 1/2008
WO WO-2008/047659 A1 4/2008
WO WO-2011/011176 A2 1/2011
WO WO-2011/028444 A1 3/2011
WO WO-2011/129017 A1 10/2011

* cited by examiner

SHOE UPPER

CROSS-REFERENCE TO RELATED APPLICATION

This application is a national stage entry, filed under 35 U.S.C. § 371, of International Application No. PCT/JP2014/064275, filed on May 29, 2014, the entire contents of which are hereby incorporated herein by reference in its entirety and for all purposes.

TECHNICAL FIELD

The present invention relates to an upper of a shoe.

BACKGROUND ART

In sports such as tennis, volleyball and soccer, a player needs to perform the direction-changing action and the braking action many times. Due to such characteristics of these sports, the upper needs to be stable in the transverse direction. Therefore, the stability of the upper has been ensured for present-day athletic shoes by using an artificial material having a high rigidity or a polyurethane-made resin material.

However, while these shoes enjoy their high stability, they are heavy and the upper buckles when bent, and the fitting quality is poor. Particularly, due to the characteristics of the sports described above, the upper undergoes a twist, or the like, in addition to simple deformations such as stretching and shrinking. Therefore, uncomfortable creases are likely to occur (awkwardness is likely to be felt on the surface of the foot), and there is a demand for improving the fitting quality. Uppers have been under development that partially use a low-rigidity mesh member or stretchable member as a way to improve the fitting quality.

CITATION LIST

Patent Literature

First Patent Document: WO 2011/129017 A1 (front page)
Second Patent Document: WO 2008/398 A1 (front page)
Third Patent Document: WO 2007/140054 A1 (front page)
Fourth Patent Document: JP2012-196488 A (front page)
Fifth Patent Document: WO 2011/028444 A1 (front page)
Sixth Patent Document: WO 2011/011176 A1 (front page)

SUMMARY OF INVENTION

The structure of the upper disclosed in WO 2011/129017 A1 will realize a reduction of weight and also realize a unique improvement to the fitting quality. With this technique, however, the reinforcement in the foot width direction is unlikely to be high, and one may not be able to expect an improvement to the stability.

Thus, it is an object of the present invention to provide a novel upper structure with stability, light weight and fitting quality.

In one aspect, an upper of the present invention includes:

a medial side portion 31 covering a medial side surface of the foot;

a lateral side portion 32 covering a lateral side surface of the foot;

a plurality of panels 11 provided in the medial side portion 31 and/or the lateral side portion 32, separated from one another in a longitudinal direction Y of the foot, and covering at least a portion of a side surface of the foot, wherein the panels 11 are pulled by a fastening member 6 toward a central (center) portion 36 between a medial side and a lateral side of the foot; and a plurality of string-shaped non-elongatable (non-stretchable) string portions 10 extending in the longitudinal direction Y, the string portions 10 placed between a pair of the plurality of panels 11 that are adjacent to each other in the longitudinal direction Y.

In the present invention, "non-elongatable" means to include non-stretchable string portions that do not either stretch or shrink, and include string portions that do not substantially stretch past a predetermined length (by forces to be applied while the shoe is worn) but that are capable of shrinking from the predetermined length.

"String-shaped string portion" means something that is thicker than a sewing thread and thinner than a rope.

Note that "longitudinal direction Y" means to include the horizontal direction parallel to the longitudinal axis of the foot and directions that are inclined upward or downward and/or medially or laterally with respect to the horizontal direction.

In this aspect, string portions placed between a pair of panels 11 will serve to reduce the weight of the upper.

The string portions, as compared with an ordinary upper member having a planar structure, will more easily twist and will more easily exhibit a deformation of shrinking by being bent. Therefore, the upper will easily deform in conformity to a shrinking deformation of the foot, or the like, following a deformation of the foot. Thus, the fitting quality will improve.

When the foot is urged to slip, inside the upper, toward the medial side or the lateral side, the non-elongatable string portions will not elongate (lengthen, stretch) past the predetermined length and will support the side surface of the medial side and the lateral side of the foot. This will realize a good stability.

DESCRIPTION OF EMBODIMENTS

Figure 1:
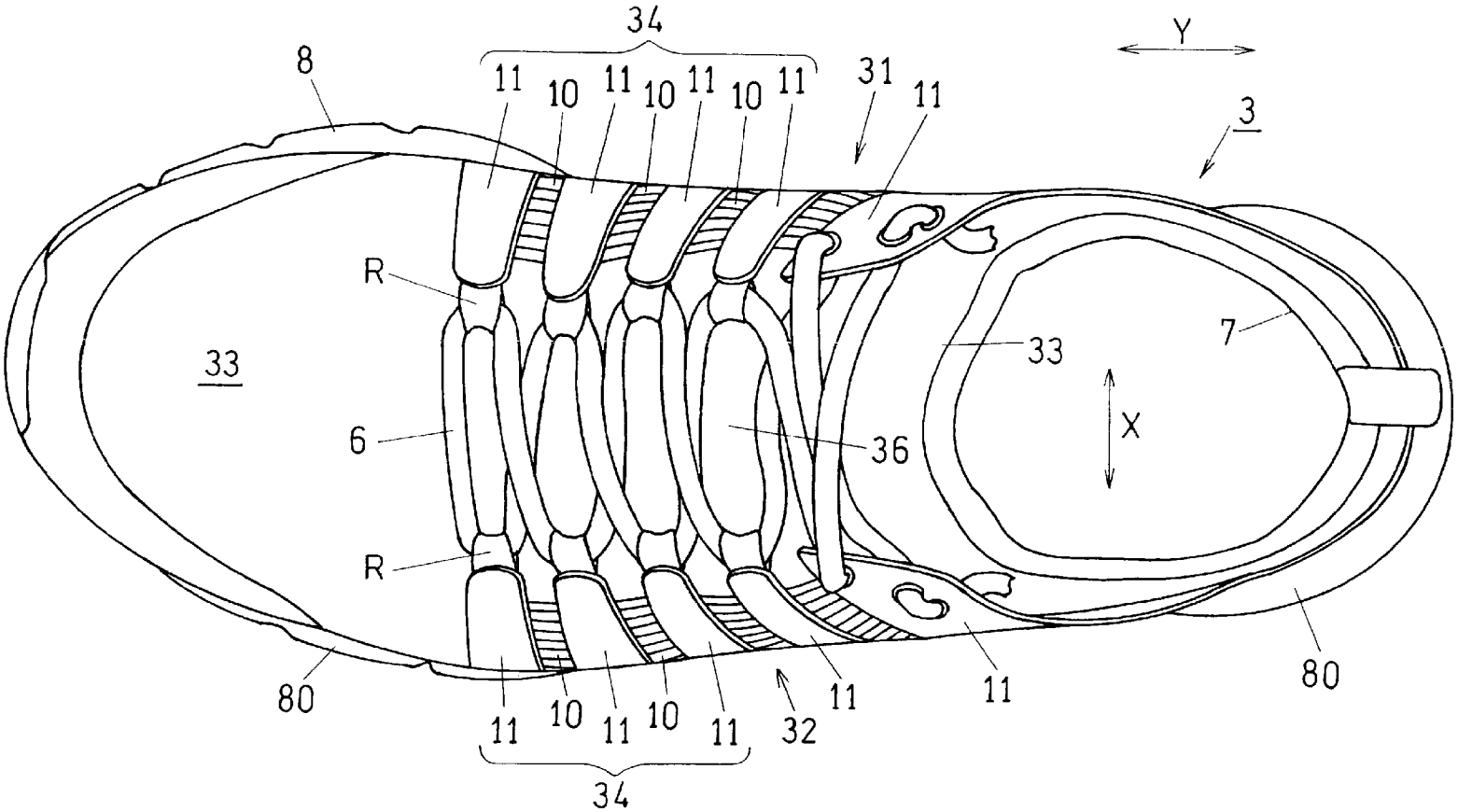
FIG. 1 is a schematic plan view showing a shoe having an upper according to an embodiment of the present invention.

Preferably, the string portions 10 are set so that the string portions 10 are freely displaceable and/or deformable in a transverse direction X of the foot and/or in an up-down direction. That is, the string portions 10 are in at least one or more state, of the state in which the string portions 10 can be easily moved or deformed in the transverse direction X of the foot or the state in which the string portions 10 can be easily moved or deformed in the up-down direction.

Note that "up-down direction" means to include the vertical direction and directions that are inclined forward or rearward and/or medially or laterally with respect to the vertical direction, and means to include the direction perpendicular to the direction in which the string portions 10 extend.

Then, the string portions, as compared with an ordinary upper member having a planar structure, will more easily twist and will more easily exhibit a deformation of shrinking by being bent.

Preferably, a width W of each string portion 10 in an up-down direction is set to be 1 mm to 15 mm.

If the width of the string portion 10 in the up-down direction is too small, the string portion 10 may strongly irritate the foot on the medial side surface and the lateral side surface. For such a reason, typically, the width of the string portion 10 in the up-down direction is preferably 1 mm or more, more preferably 1.5 mm or more, and most preferably 2 mm or more.

On the other hand, if the width of the string portion 10 in the up-down direction is too large, the string portion 10 itself will no longer have a linear structure and will come closer to a planar structure, thereby inhibiting the free displacement and deformation of the string portions 10. For such a reason, typically, the width of the string portion 10 in the up-down direction is preferably 15 mm or less, more preferably 12 mm or less, and most preferably 10 mm or less.

Preferably, a width W of each string portion 10 in an up-down direction is set to be 2 mm to 15 mm; and the string portions 10 are set so that the string portions 10 are freely displaceable and/or deformable in a transverse direction X of the foot and/or in the up-down direction.

Then, the string portions 10 will likely displace or deform freely and the irritation on the foot will be small.

Preferably, the string portions 10 are formed by a woven fabric or a knit fabric.

Then, it will be easy to produce flexible and non-elongatable (non-stretchable) string portions 10.

Preferably, the woven fabric or the knit fabric includes a plurality (of strands) of non-stretchable fibers that are long (elongated) in the longitudinal direction Y.

Then, it will be even easier to produce flexible and non-elongatable (non-stretchable) string portions 10.

Note that each string portion 10 may include one strand or a plurality of strands of another fiber that is stretchable in the longitudinal direction Y. In that case, the string portions 10 may shrink without being bent.

Preferably, at least one of the plurality of panels 11 or at least a part of the plurality of non-elongatable (non-stretchable) string portions 10 covers at least a portion of a ball O1 of a big toe on the medial side of the foot; and at least another one of the plurality of panels 11 or at least another part of the plurality of non-elongatable (non-stretchable) string portions 10 covers at least a portion of a ball O5 of a little toe on the lateral side of the foot.

With the string portions 10 and the panels 11 covering the areas of the ball O1 of the big toe and the ball O5 of the little toe, a high stability will be realized in the transverse direction.

Preferably, a length L of each string portion 10 between the pair of panels 11 that are adjacent to each other is set to be 3 to 15 mm.

If the length of the string portions 10 is too short, the free displacement or deformation of the string portions 10 will be inhibited. For such a reason, typically, the length of the string portions 10 is preferably 3 mm or more, more preferably 4 mm or more, and most preferably 5 mm or more.

On the other hand, if the length of the string portions 10 is too long, when a load in the transverse direction is applied on the foot, the string portions 10 will exhibit a deformation of being bent outward, thereby lowering the stability. For such a reason, typically, the length of the string portions 10 is preferably 15 mm or less, more preferably 12 mm or less, and most preferably 10 mm or less.

Preferably, in the medial side portion 31 or the lateral side portion 32, a ratio of a width W of the string portion 10 with respect to a pitch P in an up-down direction at which ones of the string portions 10 that are adjacent to each other in the up-down direction are arranged (e.g., placement of the string portions 10 at a predetermined frequency) is set to be 50% or more and less than 100%.

If the gap between string portions 10 and 10 that are adjacent to each other in the up-down direction is too large, the stability in the transverse direction may lower. For such a reason, the ratio W/P of the width of the string portion 10 with respect to the pitch in the up-down direction at which the string portions 10 that are adjacent to each other are arranged is preferably 50% or more, more preferably 55% or more, and most preferably 60% or more.

On the other hand, if the gap between the string portions 10 and 10 is too small, it may be difficult to arrange a plurality of string portions 10, and the production yield of the upper may lower. For such a reason, the width ratio W/P is preferably less than 100%, more preferably 95% or less, and most preferably 90% or less.

Preferably, the upper further includes a flexible member 33 that covers at least one side surface of the medial side surface and the lateral side surface of the foot and that is more stretchable at least in the longitudinal direction Y of the foot than the string portions 10, wherein a reinforcement member 34, formed by (including) the panels 11 and the string portions 10, is placed on an outer surface of the flexible member 33.

Then, the flexible member 33 is inserted between the reinforcement member 34 and the side surface of the foot. Therefore, the pressure on the surface of the foot from the string portions 10 or the panels 11 will be reduced by the flexible member 33.

Preferably, the upper further includes a flexible member 33 that covers at least one side surface of the medial side surface and the lateral side surface of the foot and that is more stretchable at least in the longitudinal direction Y of the foot than the string portions 10, wherein a reinforcement member 34, formed by (including) the panels 11 and the string portions 10, is placed along an outer surface of the flexible member 33, and at least the string portions 10 are set to be unattached to the outer surface of the flexible member 33.

Then, in addition to the pressure being reduced by the flexible member 33, the string portions 10 in the unattached state will have a high degree of freedom of displacement and deformation. Therefore, the fitting quality will improve.

More preferably, at least an upper-half area of each panel 11 is in contact with, while being unattached to, the outer surface of the flexible member 33 on a medial side and on a lateral side of an instep.

Then, not only the string portions 10 but also the upper halves of the panels 11 are in contact with, while being unattached to, the outer surface of the flexible member 33. Therefore, the panels 11 can also be easily displaced, and the fitting quality may further improve.

Preferably, the upper includes:

a mesh member 1 formed by a woven fabric or a knit fabric, defining elongate slit-shaped through holes S arranged in a plurality of columns and a plurality of rows; and at least one panel member 2 layered on the mesh member 1, with the through holes S arranged in the plurality of columns and the plurality of rows being open (not covered), wherein the string portions 10 are formed (defined) by body parts of the mesh member 1 between those of the plurality of through holes S that are spaced apart (separated) from, and adjacent to, each other in a circumferential direction of the foot.

Then, areas of the mesh member 1 between the through holes S define the string portions 10, and it will be easy to produce a large number of string portions 10 as the mesh member 1 and the panel member 2 are layered together.

More preferably, the upper further includes:

another panel member 2 separate from the at least one panel member, wherein the pair of panel members 2 forms at least a portion of the upper, with the through holes S arranged in the plurality of columns and the plurality of rows being open (not covered), and the pair of panel members 2 layered together with the mesh member 1 sandwiched therebetween.

Then, the mesh member 1, sandwiched between a pair of panel members 2 and 2, will have its front surface and back surface protected by the pair of panel members 2 and 2, and the mesh member 1 will have an improved durability.

Preferably, a flexural rigidity of the at least one panel member 2 is set to a larger value than a flexural rigidity of the mesh member 1.

By the fastening force applied to the panels 11 from the shoelace 6, the panel member 2 having a greater flexural rigidity than the mesh member 1 will fit to the side surface on the medial side and the lateral side of the foot, thereby serving to improve the stability.

On the other hand, the mesh member 1 having a smaller rigidity than the panel member 2 will increase the degree of freedom of deformation and displacement of the string portions 10, thereby serving to improve the fitting quality.

In another aspect, an upper of the present invention includes:

a mesh member 1 formed by a woven fabric or a knit fabric, defining a plurality of elongate slit-shaped through holes S arranged in a plurality of columns and a plurality of rows; and at least one panel member 2 layered on the mesh member 1, with the plurality of through holes S arranged in the plurality of columns and the plurality of rows being open (not covered), and an area (each area, portions) of the mesh member 1 between the through holes S adjacent to each other being exposed.

As the exposed areas of the mesh member 1 between the through holes S are exposed with the through holes S of the mesh member 1 being open, the exposed areas of the layered structure of the mesh member 1 and the panel member 2 will have a flexibility function. Thus, the fitting quality of the upper may improve.

On the other hand, layered areas where the panel member 2 and the mesh member 1 are layered together will have a greater rigidity than the exposed areas. Therefore, the layered areas may improve the stability of the upper.

Moreover, the through holes S of the mesh member 1 and the exposed areas of the mesh member 1 will reduce the weight of the upper.

Preferably, the upper further includes a panel member 2 different from the at least one panel member 2; and the pair of panel members 2 are layered together with the mesh member 1 sandwiched therebetween, with the plurality of through holes S arranged in the plurality of columns and the plurality of rows being open (not covered), and an area (each area, portions) of the mesh member 1 between the through holes S adjacent to each other being exposed, the panel members 2 forming at least a portion of the upper.

Then, the mesh member 1, sandwiched between the pair of panel members 2 and 2, will have its front surface and back surface protected by the pair of panel members 2 and 2, and the mesh member 1 will have an improved endurance.

If the panel member 2 is formed by a plate material of a synthetic resin, the mesh member 1 and the pair of panel members 2 and 2 can be easily layered together by bonding or welding, and a rigid layered structure will be realized.

Preferably, the exposed area (areas, portions) of the mesh member 1 extends in the longitudinal direction Y between ones of the through holes S that are spaced apart (separated) from, and adjacent to, each other in a circumferential direction of the foot, and forms a plurality of string-shaped non-elongatable (non-stretchable) string portions 10 that are freely displaceable and deformable in a transverse direction X of the foot or an up-down direction of the foot.

Then, the non-elongatable string portions 10 can easily twist and exhibit a deformation of shrinking by being bent. This will improve the fitting quality.

On the other hand, the non-elongatable string portions 10 support the foot without elongating (stretching), and this may improve the stability.

Preferably, a flexural rigidity of the at least one panel member 2 is set to a larger value than a flexural rigidity of the mesh member 1.

The panel member 2 having a greater flexural rigidity than the mesh member 1 will fit to the side surface on the medial side and the lateral side of the foot, etc., thereby serving to improve the stability.

On the other hand, the mesh member 1 having a smaller flexural rigidity than the panel member 2 will increase the degree of freedom of deformation and displacement of the exposed areas, thereby serving to improve the fitting quality.

Preferably, a flexural rigidity of the panels 11 is set to a larger value than a flexural rigidity of the string portions 10. In other words, the flexural rigidity of the string portions 10 is smaller than the flexural rigidity of the panels 11. Such rigidity setting will increase the degree of freedom of deformation and displacement of the string portions 10, thereby serving to improve the fitting quality.

EMBODIMENTS

The present invention will be understood more clearly from the following description of preferred embodiments taken in conjunction with the accompanying drawings. Note however that the embodiments and the drawings are merely illustrative and should not be taken to define the scope of the present invention. The scope of the present invention shall be defined only by the appended claims. In the accompanying drawings, like reference numerals denote like components throughout the plurality of figures.

Any feature illustrated and/or depicted in conjunction with one embodiment or alternative examples may be used in the same or similar form in one or more of alternative embodiments or alternative examples, and/or may be used in combination with, or in place of, any feature of the alternative embodiments.

Embodiment 1

Embodiment 1 of the present invention will now be described with reference to FIG. 1 to FIG. 9.

A shoe for the left foot will be illustrated in the following description.

Figure 2:
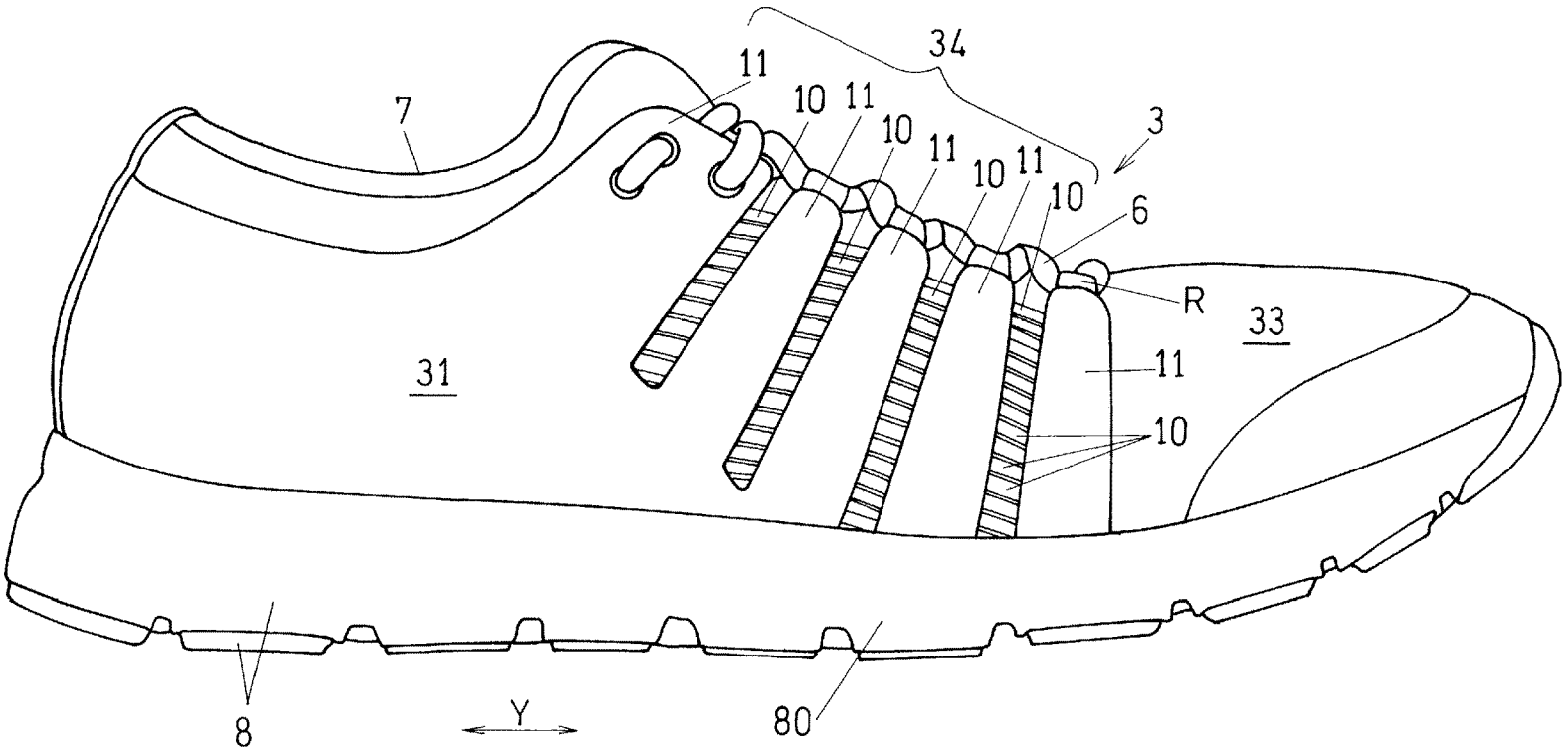
FIG. 2 is a schematic side view showing the shoe according to the embodiment as the upper is seen from the medial side.

The shoe shown in FIG. 1 is a shoe for sports or running, for example, and includes an upper 3 secured to a sole 8 shown in FIG. 2. The upper 3 includes a flexible member 33, a reinforcement member 34 and a shoelace (fastening member) 6.

The sole 8 is placed under the upper 3 and is to be in contact with the road surface. The flexible member 33 wraps the medial side surface, the lateral side surface, the toe and the heel of the foot, and is formed in the shape of a sock, for example. The reinforcement member 34 and the shoelace 6 are for fitting the flexible member 33 to the instep.

Figure 5:
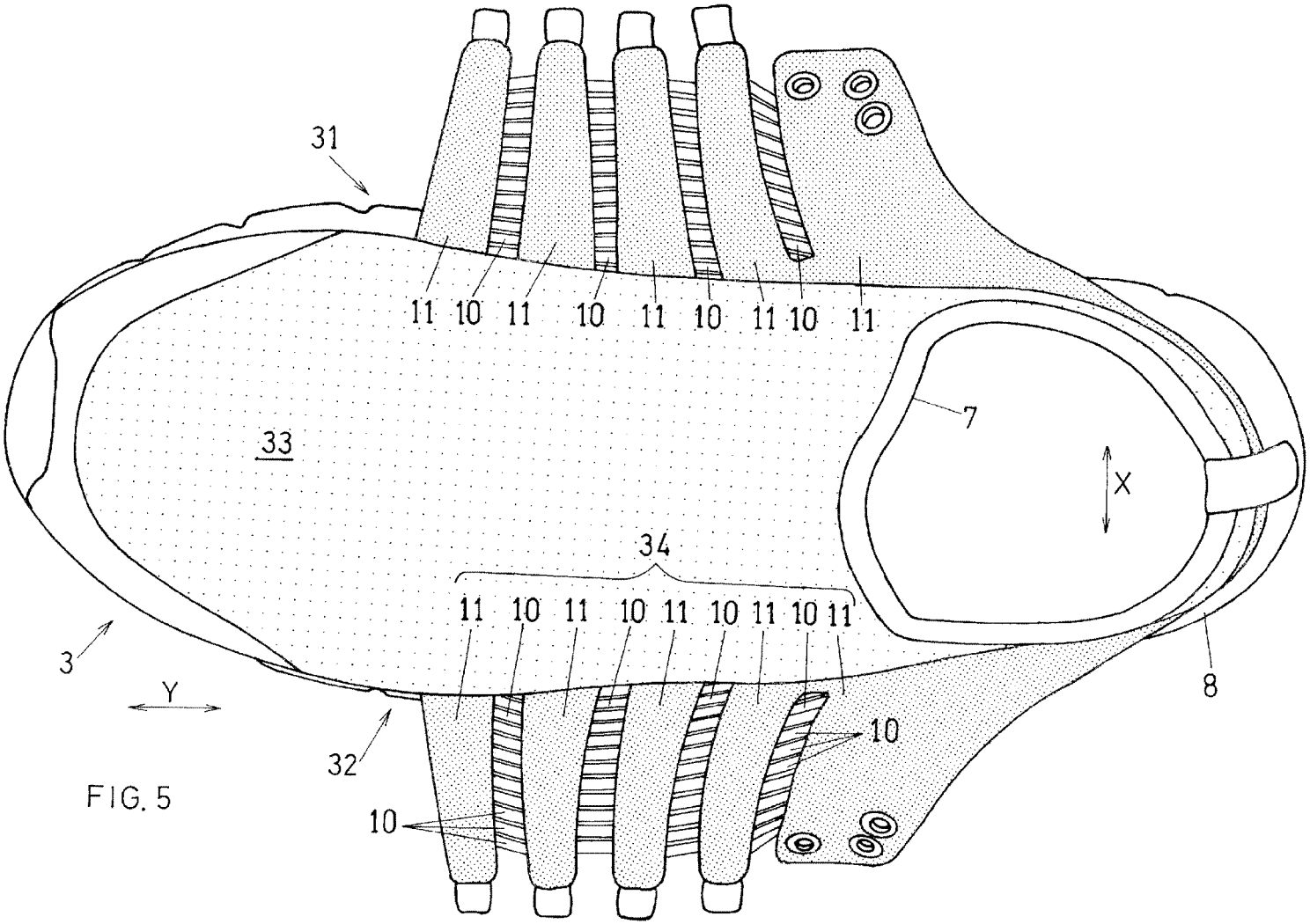
FIG. 5 is a schematic plan view showing the shoe with the shoelace removed and the reinforcement member pulled open.

Note that the area of the flexible member 33 is coarsely dotted in FIG. 5.

Figure 3:
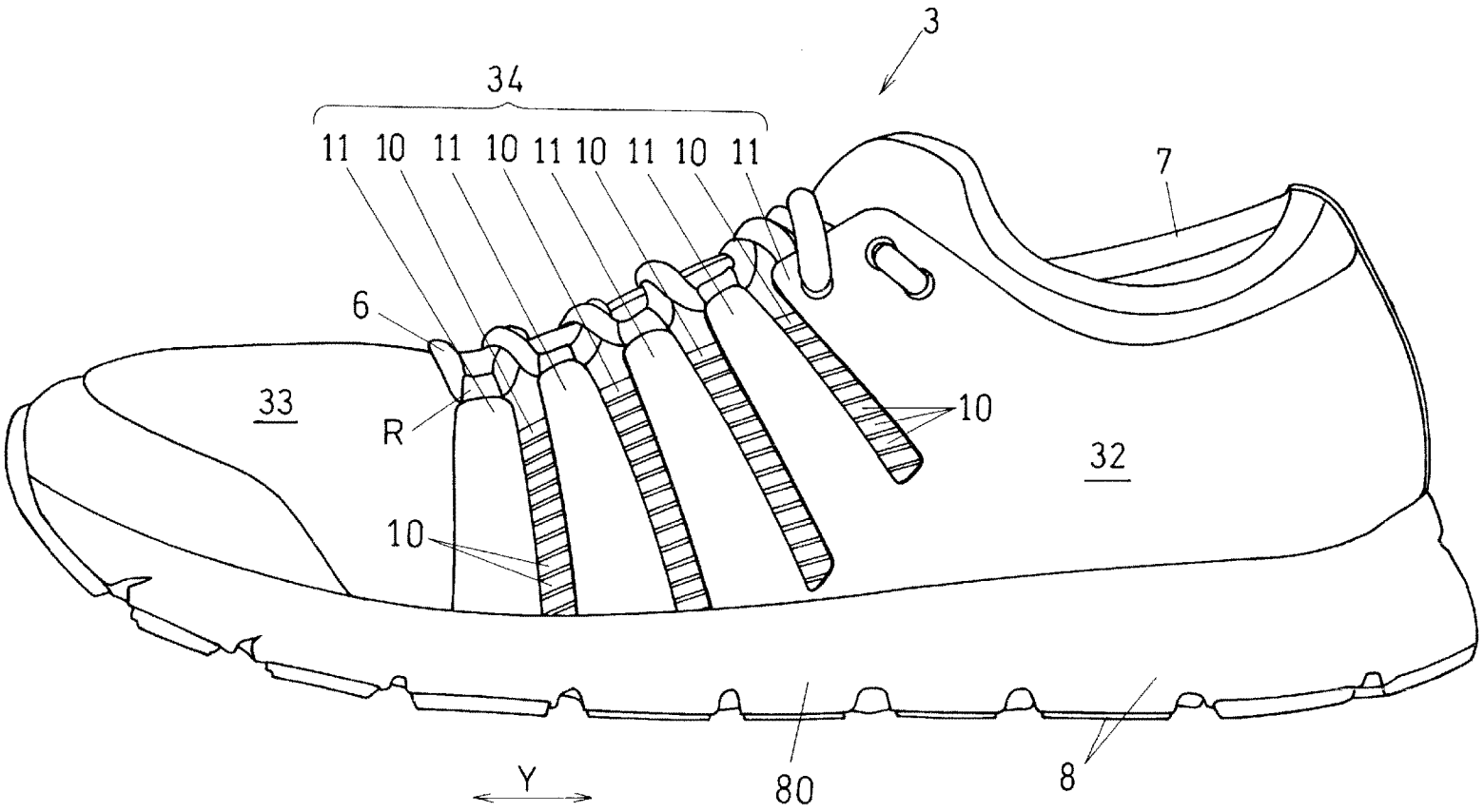
FIG. 3 is a schematic side view showing the shoe according to the embodiment as the upper is seen from the lateral side.

Although the end portions of the shoelace 6 are not shown in FIG. 1 to FIG. 3, the end portions are firmly tied together after the foot is inserted in the flexible member 33. As the end portions of the shoelace 6 are tied together, the flexible member 33 fits to the foot.

As shown in FIG. 1 to FIG. 3, the flexible member 33 includes a top line (wearing opening) 7 allowing the foot to be inserted to wear the shoe. The leg protrudes upward through the top line 7 when the shoe is worn, and the shoelace 6 is placed in an area anterior to the top line 7.

Figure 4:
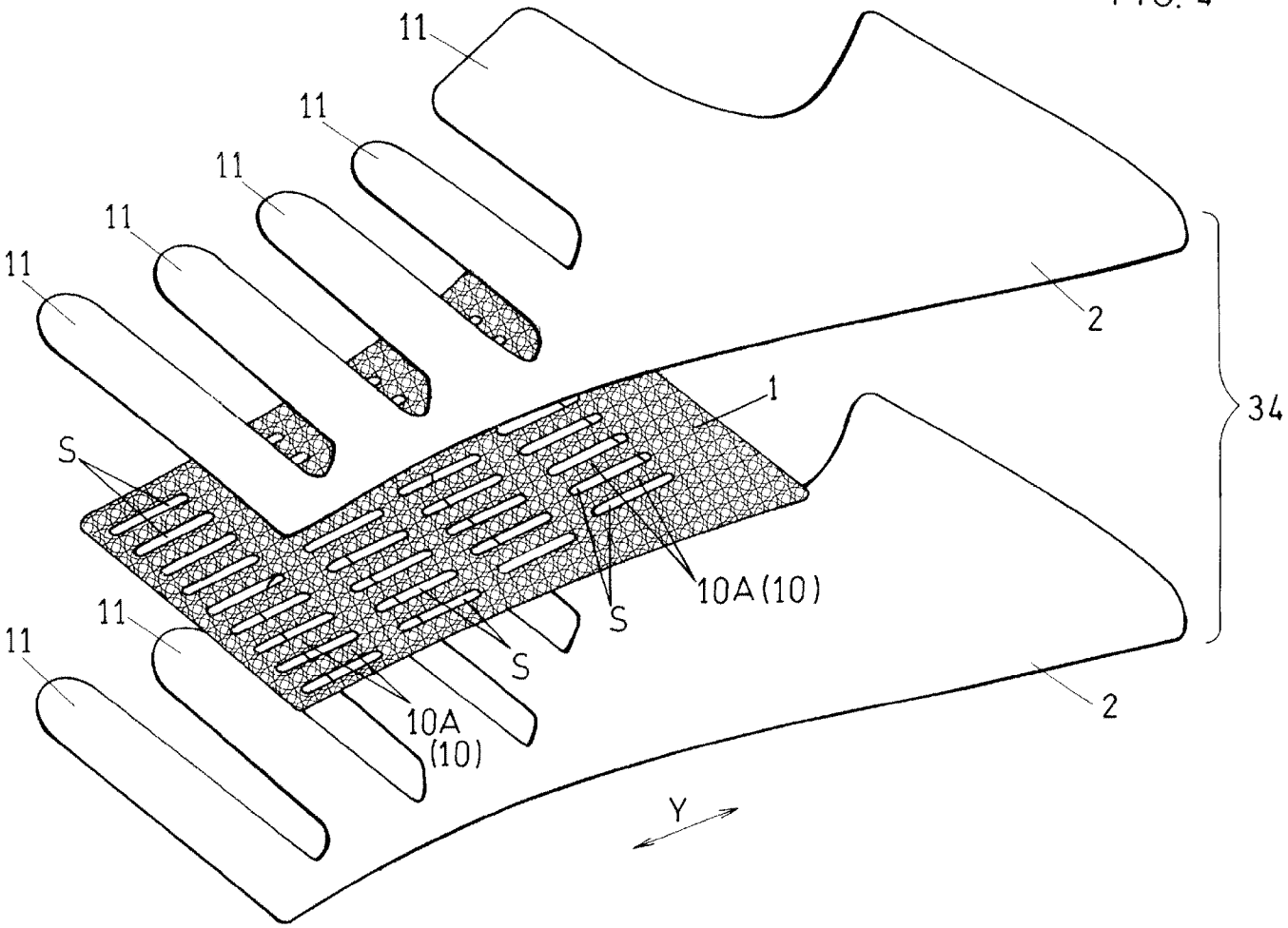
FIG. 4 is an exploded perspective view showing a reinforcement member.

As shown in FIG. 4, the reinforcement member 34 includes a mesh member 1 and a pair of panel members 2. The mesh member 1 uses such a structure and material that it is less stretchable in the longitudinal direction Y than the panel members 2. On the other hand, the panel members 2 preferably have a greater flexural rigidity than the mesh member 1. The material of the panel members 2 may be any of various materials, such as a resin part, an artificial leather, a TPU or a rubber.

Note that the flexural rigidity of the mesh member 1 and that of the panel members 2 may be similar to each other.

The panel members 2 are comb-shaped, for example, including a plurality of panels 11 to be described later. On the other hand, the mesh member 1 includes a large number of string portions 10 to be described later.

Figure 6:
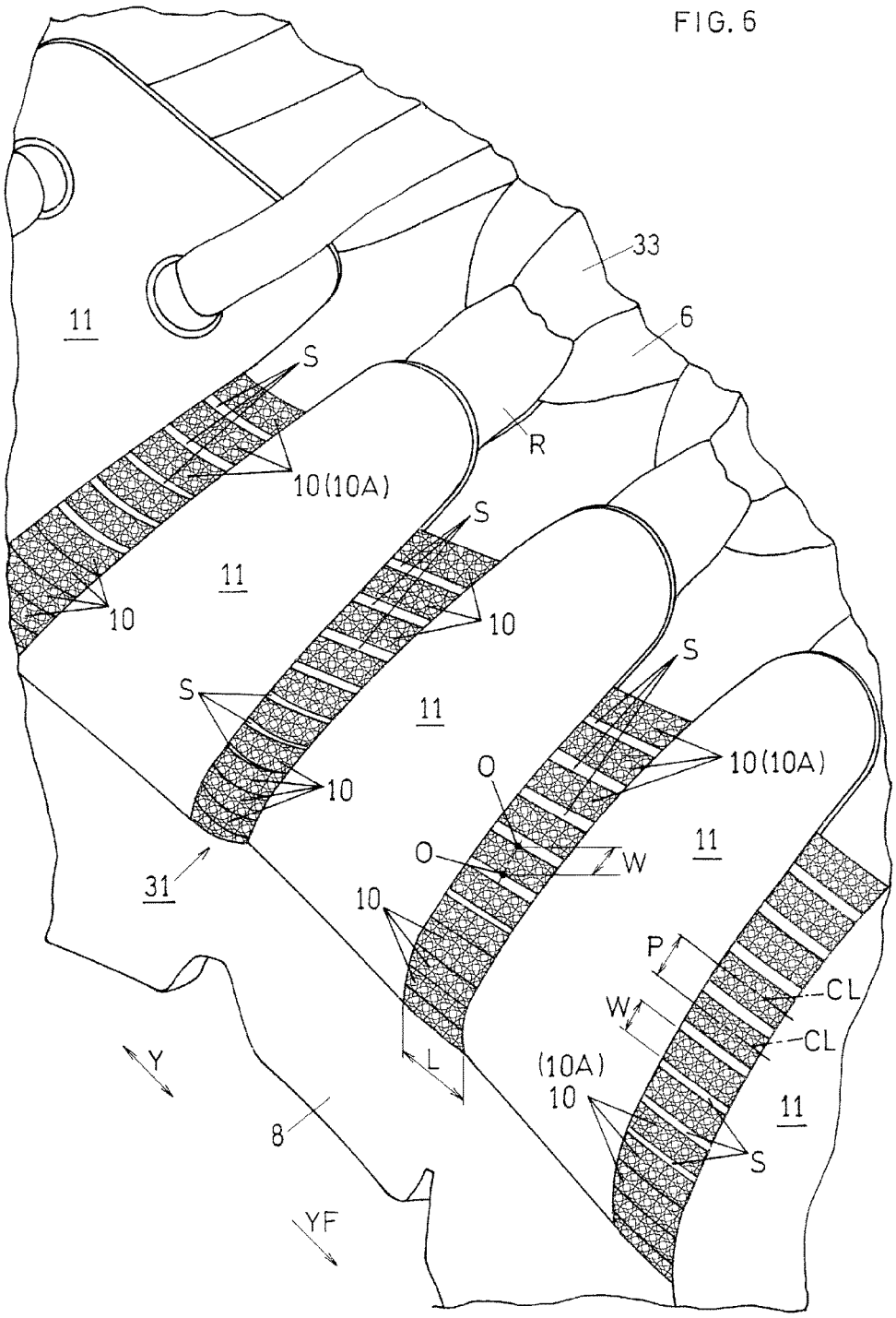
FIG. 6 is a perspective view showing, on an enlarged scale, a medial side portion in the stationary standing (standstill) position, as seen diagonally from the front direction.

Note that the mesh member 1 of FIG. 4 and the string portions 10 of FIG. 6 are geometrically patterned. On the other hand, the area of the panels 11 is densely dotted in FIG. 5.

The mesh member 1 of FIG. 4 is formed by a woven fabric or a knit fabric, for example, and is more preferably formed by a woven fabric, defining a larger number of elongate slit-shaped through holes S arranged in a plurality of columns and a plurality of rows. The panel members 2 are layered on the front side and the back side of the mesh member 1, while the through holes S arranged in the plurality of columns and the plurality of rows are open and the areas of the mesh member 1 between through holes S that are adjacent to each other (hereinafter referred to as exposed portions 10A) are exposed. That is, the panel members 2 are layered together with the mesh member 1 sandwiched therebetween.

Note that the mesh member 1 may be formed by a thin resin film (FRP) containing a reinforcement fiber extending in the longitudinal direction Y.

The reinforcement member 34 of FIG. 1 to FIG. 3 is joined with the upper surface of a midsole 80 by bonding and/or welding, for example, and includes a medial side portion 31 covering the medial side surface of the instep and a lateral side portion 32 covering the lateral side surface of the instep. The medial side portion 31 and the lateral side portion 32 of the reinforcement member 34 include a plurality of panels 11 and a large number of string portions 10.

Next, the panels 11 and the string portions 10 will be described in detail. Note that the medial side portion 31 and the lateral side portion 32 are similar in structure.

In the medial side portion 31 and the lateral side portion 32, the panels 11 are separated from each other in the longitudinal direction Y of the foot, covering at least a portion of the side surface of the foot, wherein the panels 11 are pulled by the shoelace (an example of the fastening member) 6 toward a center portion 36 between the medial side and the lateral side of the foot. That is, for example, loops R are sewn to the upper end portions of the panels 11 of FIG. 1, with the shoelace 6 passed through the loops R.

The panels 11 of FIG. 2 and FIG. 3 covering the side surface of the instep extend in the transverse direction X of the foot (FIG. 1) and/or in the up-down direction (including an inclined up-down direction). Note that the string portions 10 cover the side surface of the instep.

Figure 10:
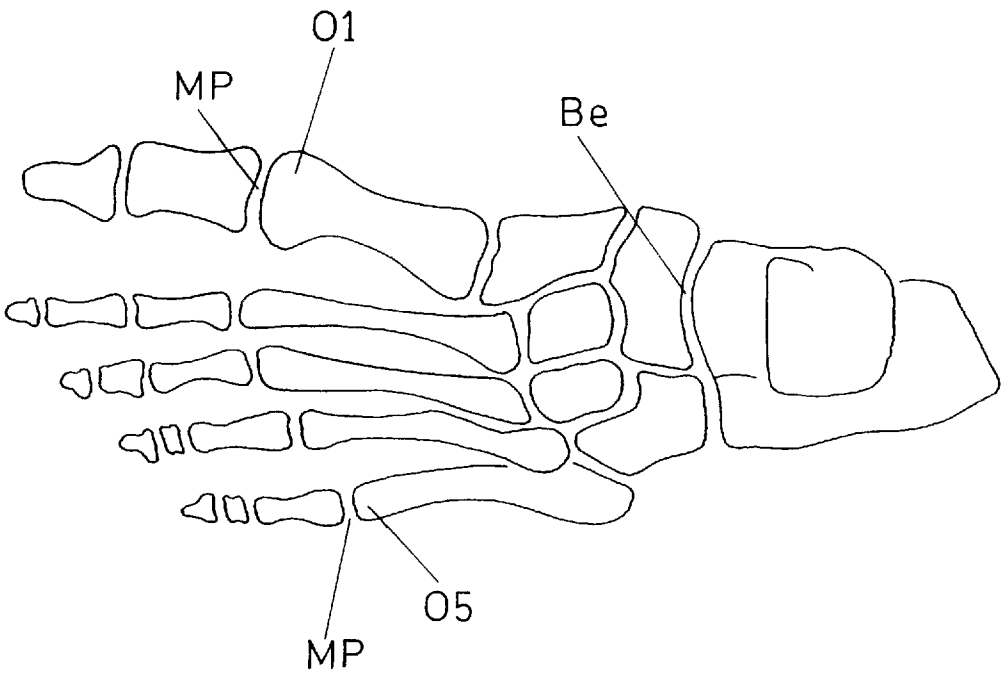
FIG. 10 is a schematic plan view showing the bone structure of the foot.

Herein, instep means a part that is posterior to the metatarsal phalangeal joint MP of FIG. 10 and anterior to the anterior end Be of the talus, and that covers the upper surface and the side surface of the foot. Note that the panels 11 may or may not cover the toe anterior to the metatarsal phalangeal joint MP and the heel portion posterior to the anterior end Be of the talus as do the posterior panels 11 of FIG. 2.

The panels 11 covering the side surface of the instep are each formed in a rectangular band shape (strip shape) extending in a diagonal posterior direction or in the up-down direction toward the midsole 80 from the upper end portion thereof with which the loop R is joined. The panels 11 are separated from each other in the longitudinal direction Y or in a diagonal longitudinal direction, with a large number of string portions 10 placed between panels 11 that are adjacent to each other.

The slit-shaped through holes S of the mesh member 1 of FIG. 4 extend generally in parallel to each other in a diagonal longitudinal direction Y. The through holes S are regularly arranged in the diagonal longitudinal direction Y and in the transverse direction.

Areas between through holes S in the longitudinal direction Y are joined with the panels 11 of the panel members 2. Thus, each exposed area 10A forms a string portion 10 of FIG. 3 extending in the longitudinal direction Y between those through holes S that are separated from, and adjacent to, each other in the circumferential direction of the foot.

The string portions 10 are non-elongatable (non-stretchable) in the longitudinal direction Y. Such non-stretchable string portions 10 may be formed by the woven fabric of the mesh member 1 of FIG. 4 including a plurality of strands of a non-stretchable fiber that are long in the longitudinal direction Y.

Note that the string portions 10 may be stretchable by including another fiber stretchable in the longitudinal direction Y.

As shown in FIG. 1 to FIG. 3, each string portion 10 is formed in a string-like form placed between a pair of panels 11 adjacent to each other the longitudinal direction Y and extending in the longitudinal direction Y. On the other hand, the width W in the up-down direction of each string portion 10 of FIG. 6 is set to be about 2 mm to about 5 mm, for example, and each string portion 10 has a planar shape with a small area and is formed in a linear shape. Thus, the string portions 10 are set so that the string portions 10 are freely displaceable and/or deformable in the transverse direction X of the foot (FIG. 1) and/or in the up-down direction.

As shown in an enlarged scale in FIG. 6, the width W in the up-down direction of the string portion 10 means the distance between the upper edge and the lower edge of one string portion 10. In other words, the width W means the distance between a pair of intersections O and O at which a virtual line intersects with the two edges of one string portion 10, wherein the virtual line extends across the string portion 10 in the up-down direction or in a diagonal up-down direction (extends perpendicular to the direction in which the string portion 10 extends). Note that these distances should be considered to be those along the curve of the surface of the foot.

In the medial side portion 31 and the lateral side portion 32, the plurality of string portions 10 are arranged generally at a constant pitch P in the up-down direction. The ratio W/P of the width W with respect to the pitch P of the string portions 10 in the up-down direction is set to be about 60% to about 80%, for example.

Note that the pitch P of the string portions 10 means the distance between the center line CL of one string portion 10 and the center line CL of another adjacent string portion 10, with the center line extending in the extending direction of the string portion 10.

The length L of the string portions 10, i.e., the length L of the string portions 10 between a pair of panels 11 that are adjacent to each other, is set to be about 4 to about 10 mm, for example.

Note that the preferable thickness of the string portions 10, i.e., the thickness of the mesh member 1 of FIG. 4, will commonly be about 0.5 to about 1.5 mm.

The flexible member 33 of FIG. 5 is formed by, for example, a foamed resin, a knit fabric, a meshed member or a combination thereof, and is more stretchable in the longitudinal direction Y than the string portions 10 and the panels 11. As shown in FIG. 1 to FIG. 3, the reinforcement member 34 including the panels 11 and the string portions 10 are placed on the outer surface of the flexible member 33.

The reinforcement member 34 including the panels 11 and the string portions 10 is placed along the outer surface of the flexible member 33 on the medial side and on the lateral side of the instep. On the medial side and on the lateral side of the instep, the majority of the panels 11 and the string portions 10 are set to be unattached to the outer surface of the flexible member 33. In the illustrated example, as the string portions 10 are set to be unattached to the outer surface of the flexible member 33, the string portions 10 are freely displaceable and/or deformable in the transverse direction X of the foot and/or in the up-down direction. Note that it is preferred that at least an upper-half area of each panel 11 is in contact with, while being unattached to, the outer surface of the flexible member 33 on the medial side and on the lateral side of the instep.

On the other hand, the lower edge of the reinforcement member 34 is attached (secured) to the midsole 80 as described above. The reinforcement member 34 is attached (sewn) to the flexible member 33 at the rear end of the upper 3.

In the present invention, "attached" may be replaced by the word "secured", and it conceptually means that objects are joined together in such a manner that they cannot be removed easily. Specifically, "attached" means that objects are joined together by means of bonding, welding or sewing, or by a combination of two or more of these means.

In the present invention, "unattached state" means a free state in which the panel 11 or the reinforcement member 34 is not attached to the flexible member 33. The panel 11 or the reinforcement member 34 in the unattached state is not bound by the flexible member 33 and will be allowed to undergo displacement or deformation such as twist or rotation about the position of attachment as the center. On the other hand, areas of the flexible member 33 where the string portions 10 or the panels 11 are not attached will be allowed to undergo stretching/shrinking deformation in response to deformation of the foot or the upper.

On the medial side shown in FIG. 2, at least one of the plurality of panels 11 or at least a part of the plurality of non-stretchable string portions 10 covers at least a portion of the side surface of the ball O1 of the big toe on the medial side of the foot shown in FIG. 10. On the other hand, on the lateral side shown in FIG. 3, at least one of the plurality of panels 11 or at least a part of the plurality of non-stretchable string portions 10 covers at least a portion of the side surface of the ball O5 of the little toe on the lateral side of the foot shown in FIG. 10.

Next, the behavior of the present upper will be described. That is, the behavior of the present upper during the transition from the stationary standing position shown in FIG. 6 and FIG. 8 to the dorsiflexed position of FIG. 7 and FIG. 9 in which the heel is off the ground will be described. Note that "dorsiflexion of the foot" in the present embodiment means dorsiflexion of a joint within the foot (e.g., the metatarsal phalangeal joint, the interphalangeal joint, etc.).

Figure 7:
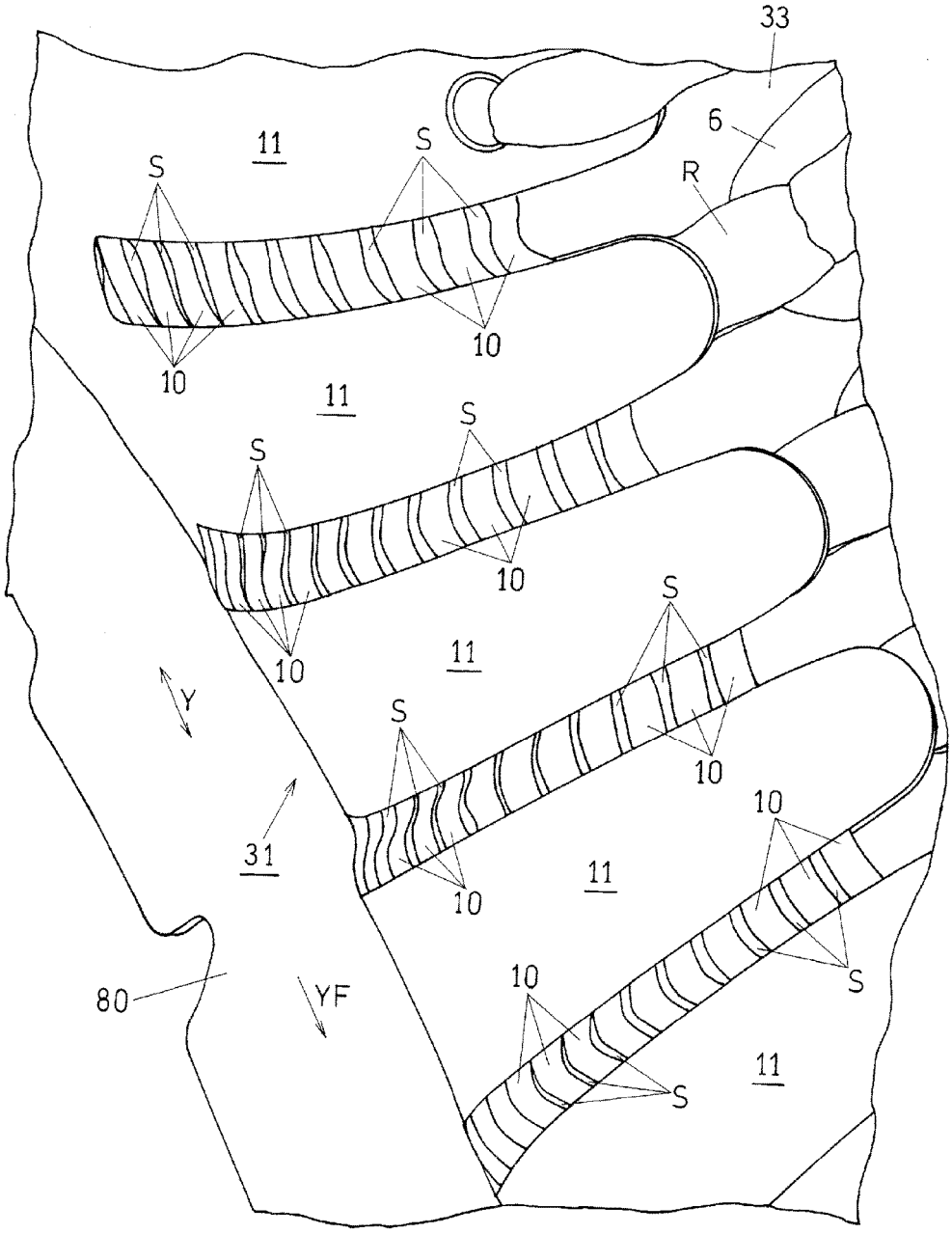
FIG. 7 is a perspective view, on an enlarged scale, the medial side portion when the foot is dorsiflexed, as seen diagonally from the front direction.
Figure 8:
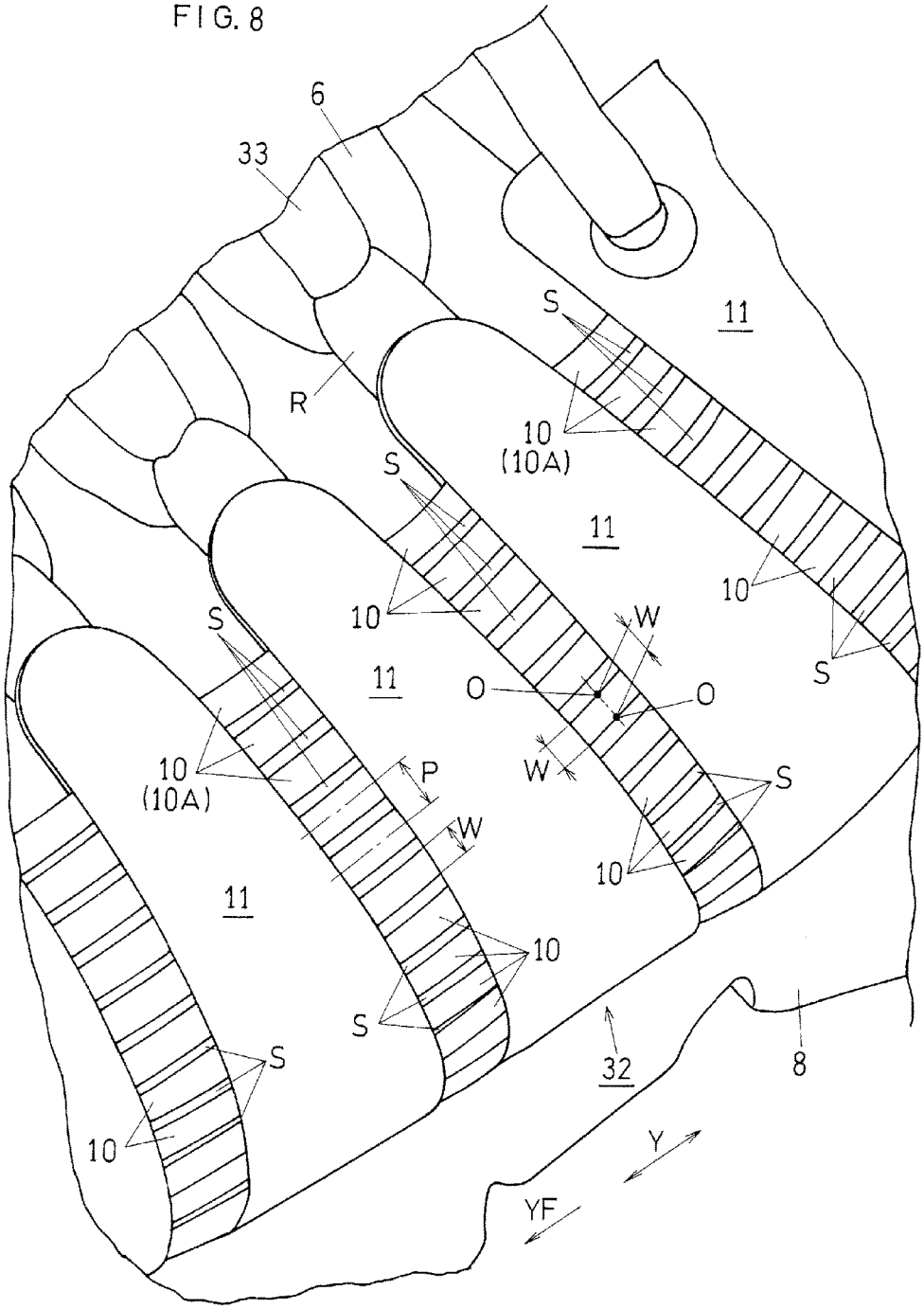
FIG. 8 is a perspective view showing, on an enlarged scale, a lateral side portion in the stationary standing position, as seen diagonally from the front direction.
Figure 9:
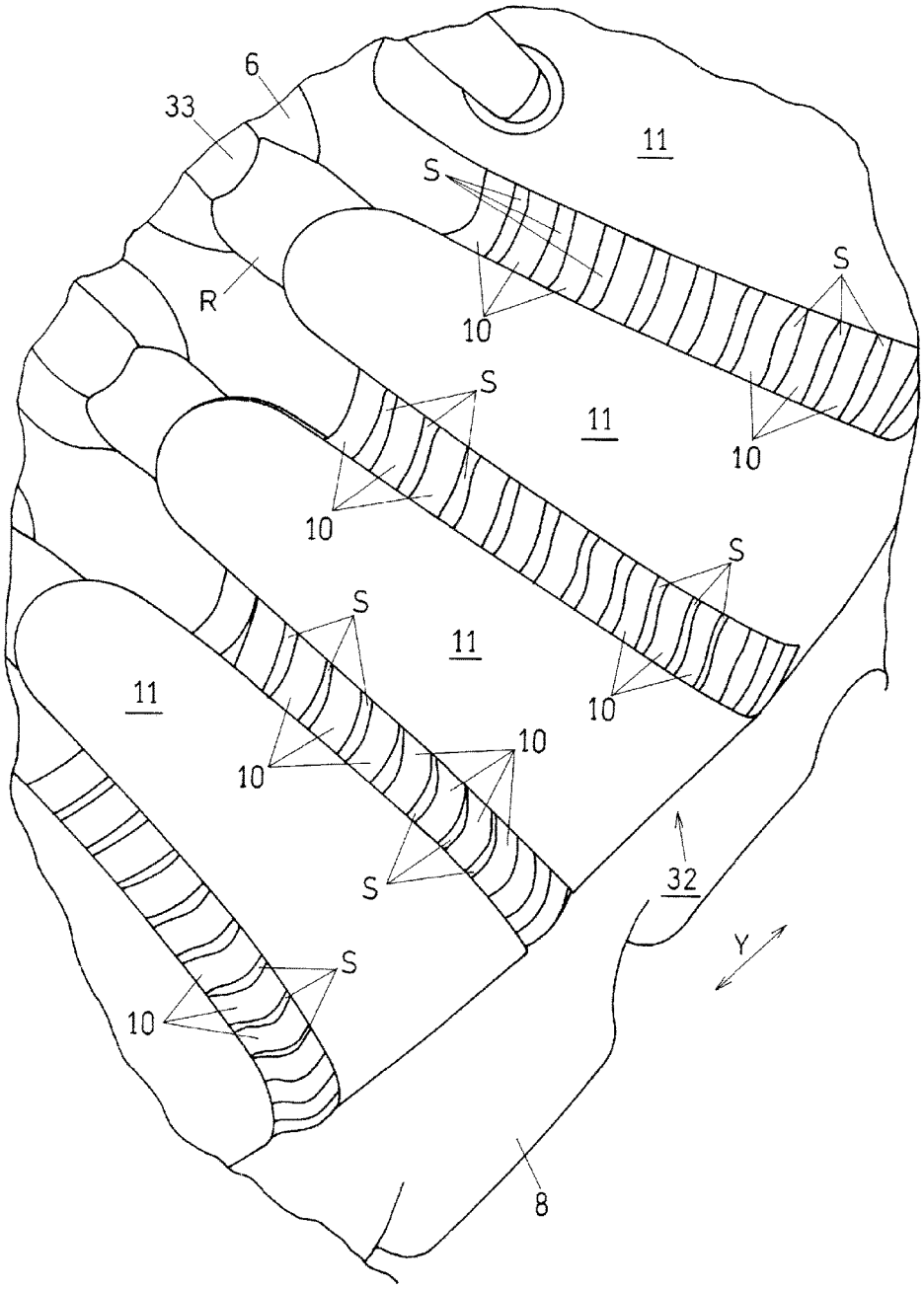
FIG. 9 is a perspective view showing, on an enlarged scale, the lateral side portion when the foot is dorsiflexed, as seen diagonally from the front direction.

Now, when the shoe or the foot of FIG. 7 or FIG. 9 is dorsiflexed, the upper surface of the instep shrinks.

On the other hand, the string portions 10 of FIG. 7 (and FIG. 9), when dorsiflexed, exhibit a deformation as if it were shrunk in the direction along the upper surface of the instep. This deformation may be realized by the string portions 10 actually shrinking, as well as by deformation of the surface of the planar string portions 10 into a curved surface.

That is, as can be seen from a comparison between FIG. 6 and FIG. 7, the panels 11 displace so that the distance between panels 11 that are adjacent to each other shortens upon dorsiflexion. The lower end of the panel member 2 is attached to the midsole 80. Therefore, each panel 11 inclines in the anterior direction YF about the position of attachment as the center. Thus, the panels 11 and the string portions 10 displace and deform at the same time.

On the other hand, when a force is applied in the transverse direction X of the foot in the upper 3 of FIG. 1, the panels 11 pulled toward the center portion 36 by the shoelace 6 fit to, and support, the side surfaces on the medial side and the lateral side of the foot. Then, the non-stretchable string portions 10 will resist the force, thereby reducing the movement of the ball O1 of the big toe of FIG. 10 toward the medial side and reducing the movement of the ball O5 of the little toe toward the lateral side.

Next, alternative examples will be described.

Figure 11:
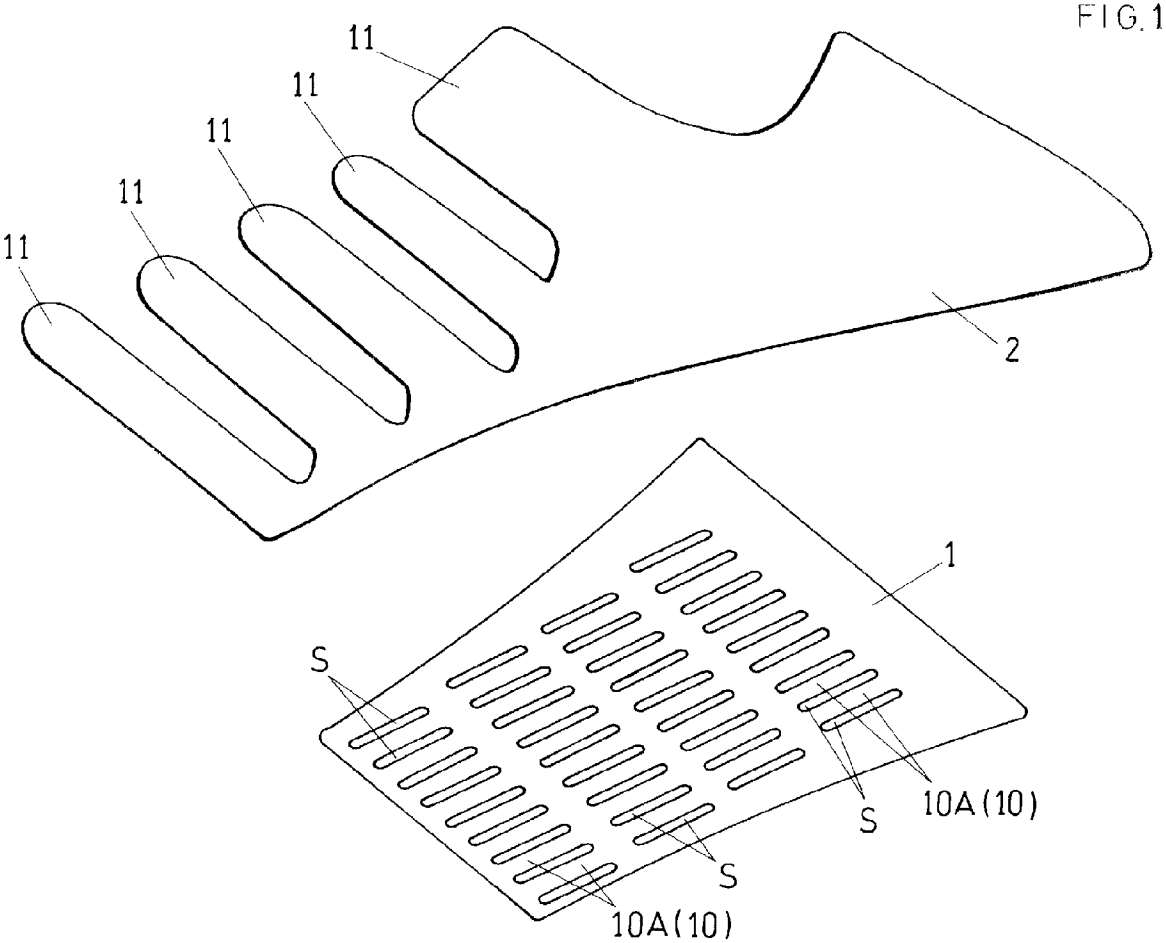
FIG. 11 is an exploded perspective view showing an alternative example of a reinforcement member.

As shown in FIG. 11, the reinforcement member 34 may include a single mesh member 1 layered with a single panel member 2.

Figure 12:
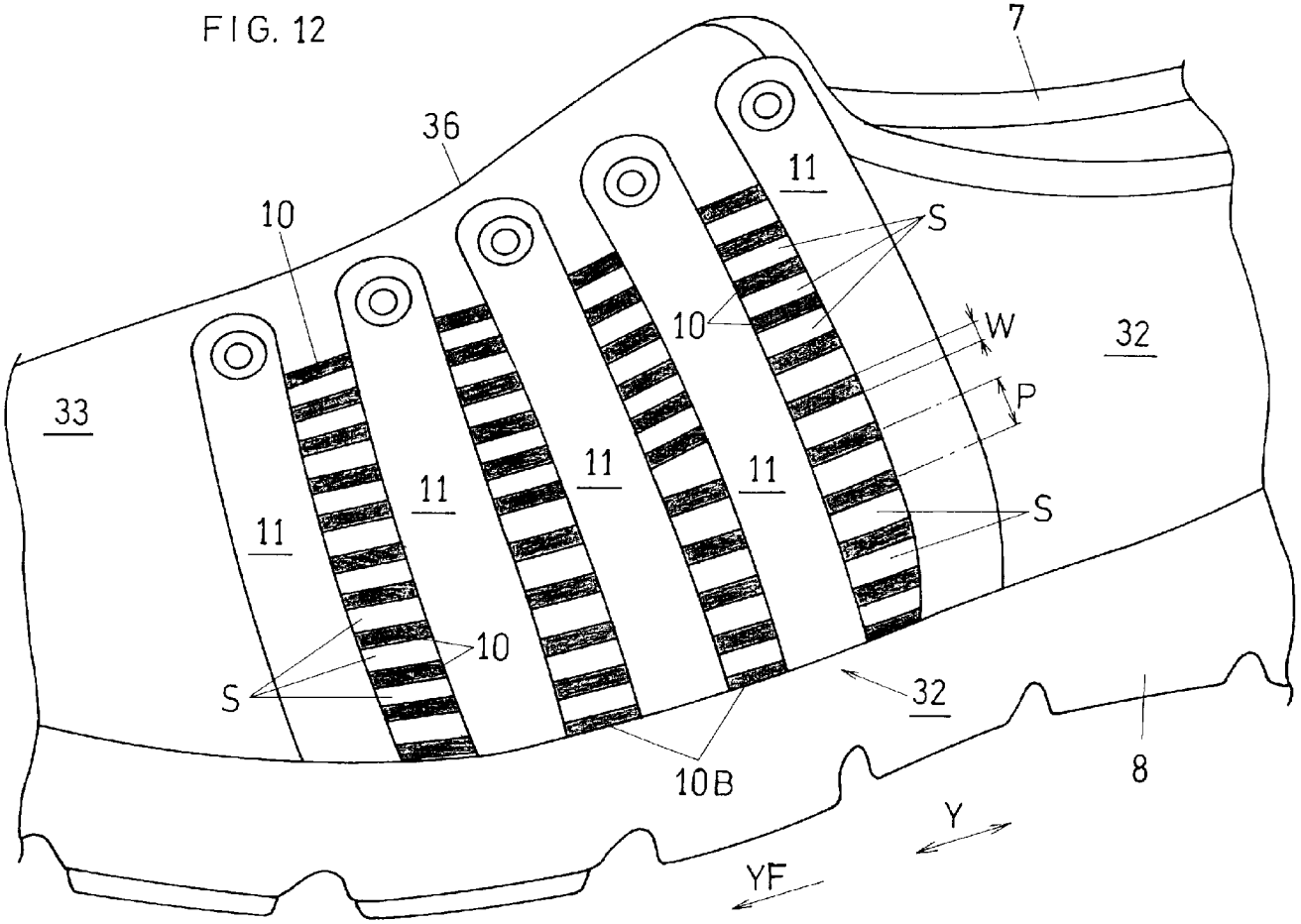
FIG. 12 is a schematic side view showing an alternative example of an upper with the shoelace removed.

In FIG. 12 showing another alternative example, the string portions 10 are shown in solid black. A large number of string members 10B may be sandwiched between the panels 11 and the flexible member 33, thereby forming the string portions 10 between the panels 11 and 11. Also in this case, it is preferred that the string portions 10 are set to be unattached to the flexible member 33.

While preferred embodiments have been described above with reference to the drawings, various obvious changes and modifications will readily occur to those skilled in the art upon reading the present specification.

For example, a lower half or a whole of each panel may be secured to the flexible member.

The flexural rigidity of the panel member may be smaller than or similar to that of the mesh member.

The sole placed under the upper may only include a so-called "outsole".

The panels and the string portions may be provided only in one of the medial side portion and the lateral side portion.

A tongue may be provided in the center portion of the upper.

The shoelace passing holes may be eyelets instead of loops.

A belt may be employed as the fastening member instead of, or in addition to, a shoelace.

Thus, such changes and modifications are deemed to fall within the scope of the present invention, which is defined by the appended claims.

INDUSTRIAL APPLICABILITY

The present invention is applicable to shoes for court sports and running shoes, and also to shoes of various other applications such as walking.

REFERENCE SIGNS LIST

1: Mesh member 10: String portion 10A: Exposed portion
10B: String (Lace) member
2: Panel member 11: Panel
3: Upper 31: Medial side portion 32: Lateral side portion
33: Flexible member 34: Reinforcement member 36: Center portion
6: Shoelace (fastening member) 7: Top line 8: Sole 80: Midsole
L: Length P: Pitch
R: Loop S: Through hole
O1: Ball of big toe O5: Ball of small toe
X: Transverse direction Y: Longitudinal direction W: Width W/P: Width ratio

The invention claimed is:

1. An upper of a shoe configured to cover at least a portion of a foot, the upper comprising:

a medial side portion configured to cover a medial side surface of the foot;

a lateral side portion configured to cover a lateral side surface of the foot;

a plurality of panels provided in the medial side portion and/or the lateral side portion, configured to be separated from one another in a longitudinal direction of the foot, and configured to cover at least a portion of a side surface of the foot, a fastening member configured to pull the panels toward a central portion between a medial side and a lateral side of the foot;

a plurality of string-shaped non-elongatable string portions extending in the longitudinal direction, the string portions placed between a pair of the plurality of panels that are adjacent to each other in the longitudinal direction;

a mesh member formed by a woven fabric or a knit fabric, having elongate slit-shaped through holes arranged in a plurality of columns and a plurality of rows; and at least one panel member layered on the mesh member, wherein each of the string portions is formed by a body part of the mesh member between two of the plurality of through holes that are configured to be spaced apart from, and adjacent to, each other in a circumferential direction of the foot.

2. The upper according to claim 1, further comprising:

another panel member separate from the at least one panel member, wherein the at least one and the other panel members form at least a portion of the upper while being layered together, with the mesh member sandwiched therebetween.

3. The upper according to claim 1, wherein a flexural rigidity of the at least one panel member is set to a larger value than a flexural rigidity of the mesh member.

4. An upper of a shoe, the upper comprising:

a mesh member formed by a woven fabric or a knit fabric, having a plurality of elongate slit-shaped through holes arranged in a plurality of columns and a plurality of rows; and at least one panel member layered on the mesh member, with the plurality of through holes arranged in the plurality of columns and the plurality of rows being open, and an area of the mesh member between the through holes adjacent to each other being exposed.

5. The upper according to claim 4, wherein:

the upper further comprises another panel member different from the at least one panel member; and the at least one and the other members are layered together with the mesh member sandwiched therebetween, with the plurality of through holes arranged in the plurality of columns and the plurality of rows being open, and an area of the mesh member between the through holes adjacent to each other being exposed, the at least one and the other members forming at least a portion of the upper.

6. The upper according to claim 4, wherein the area, which exposed, of the mesh member extends in the longitudinal direction between ones of the through holes that are spaced apart from, and adjacent to, each other in a circumferential direction of the foot, and forms a plurality of string-shaped non-elongatable string portions that are configured to be freely displaceable and deformable in a transverse direction of the foot or an up-down direction of the foot.

7. The upper according to claim 4, wherein a flexural rigidity of the at least one panel member is set to a larger value than a flexural rigidity of the mesh member.

* * * * *